United States Patent [19]

Nakabo et al.

[11] 4,215,946

[45] Aug. 5, 1980

[54] IMPACT RECEIVING STRUCTURE FOR IMPACT TYPE PRINTING MECHANISM

[75] Inventors: Satoru Nakabo, Tokyo; Tasaku Wada, Naritanishi; Kazumasa Mihira, Tokyo, all of Japan

[73] Assignee: Kokusai Denshin Denwa Kabushiki Kaisha, Tokyo, Japan

[21] Appl. No.: 872,819

[22] Filed: Jan. 27, 1978

[30] Foreign Application Priority Data

Feb. 1, 1977 [JP] Japan ..... 52-9281

[51] Int. Cl.[2] ..... B41J 29/02

[52] U.S. Cl. ..... 400/689; 400/174; 400/656; 400/661; 400/661.3

[58] Field of Search ..... 400/48, 174, 175, 656, 400/657, 661, 661.1, 661.3, 689

[56] References Cited

U.S. PATENT DOCUMENTS

| | | | |
|---|---|---|---|
| 39,201 | 7/1963 | Holly et al. | 400/661.3 X |
| 1,235,754 | 8/1917 | Anderson | 400/661.3 |
| 1,586,094 | 5/1926 | Lindburg | 400/661 |
| 2,266,275 | 12/1941 | Schuler | 400/661 |

FOREIGN PATENT DOCUMENTS

| | | | |
|---|---|---|---|
| 1270051 | 6/1968 | Fed. Rep. of Germany | 400/661.1 |
| 1575178 | 6/1969 | France | 400/661.3 |
| 692775 | 6/1940 | Fed. Rep. of Germany | 400/661.1 |
| 466209 | 5/1939 | United Kingdom | 400/661.3 |
| 472515 | 9/1937 | United Kingdom | 400/661.3 |

OTHER PUBLICATIONS

IBM Technical Disclosure Bulletin, "Platen Construction", Yosmali, vol. 8 No. 8, Jan. 1966, p. 1132.

*Primary Examiner*—Ernest T. Wright, Jr.
*Attorney, Agent, or Firm*—Robert E. Burns; Emmanuel J. Lobato; Bruce L. Adams

[57] ABSTRACT

An impact receiving structure for an impact type printing mechanism, in which vibration members for guiding along branched paths the vibration of an impact receiving face member, which is vibrated by the striking energy of a printing hammer, are provided at other positions than the printing face of a platen or at the inside of a type drum in the impact type printing mechanism, and in which elastic vibration absorbing materials are packed in close contact with the vibration members, so that noise attendant with the printing hammer impact can be effectively attenuated.

6 Claims, 14 Drawing Figures

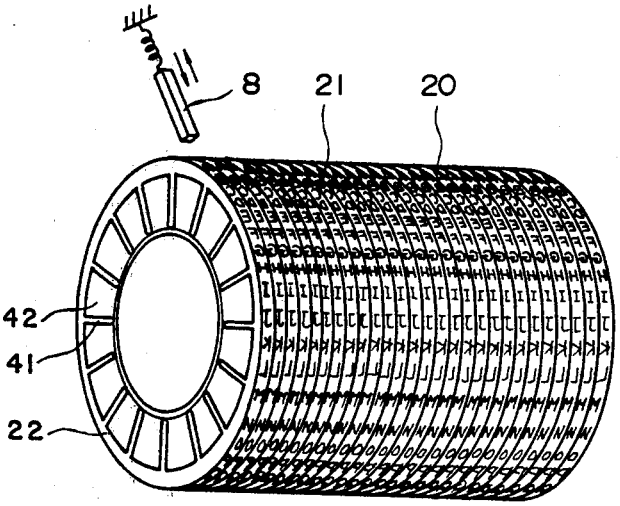
Fig. 5
Fig. 6
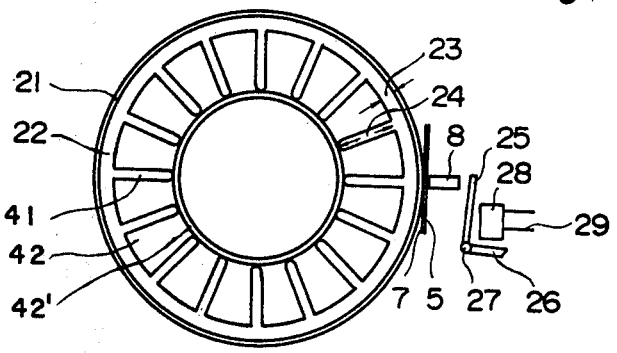

Fig. 7A
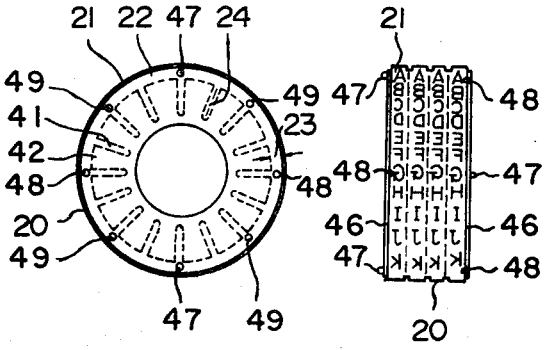
Fig. 7B
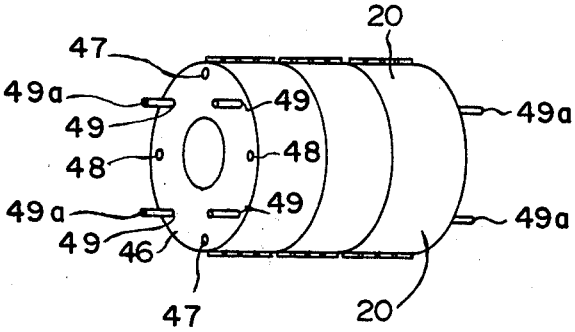
Fig. 8

IMPACT RECEIVING STRUCTURE FOR IMPACT TYPE PRINTING MECHANISM

BACKGROUND OF THE INVENTION

1. Field Of The Invention

This invention relates to an impact receiving structure for a platen or a type drum of an impact type printing mechanism.

2. Description Of The Prior Art

There has been heretofore proposed a belt type impact printer in which types are disposed on a belt. A type belt is driven by pulleys to run at the front of a platen which also serves as a belt guide. The platen is screwed at attachment portions to a base. The types on the type belt, which travels at the front of the platen, are printed on a recording paper when printing hammers are driven by printing magnets to strike the types through the recording paper and an ink ribbon. In an ordinary operation of belt type printers of this kind, the contents of input data are arranged on a line of digits by electronic circuit processing, and at each time when the type corresponding to the data of each digit passes at the front position of a printing hammer, a magnet driver is driven to actuate the corresponding hammer with the top end of the magnet driver, thereby printing to record the input data. Springs are employed for pulling the hammers back to their restored positions. When driven for printing, to the hammer is imparted an impulsive force of several kg/cm or a few dozen kg/cm, so that the striking energy is mostly applied to the platen through the ink ribbon, the recording paper and the type belt and is further transmitted to the entire printing mechanism through the base to which the platen structure is secured at the attachment portions, thus causing noises. If there are data to be printed for all digits, the hammers are driven all together usually within several hundred milli-seconds, generating very disturbing noises. In attempts to reduce noise, it is the practice in the art to attach a polyurethane sound absorbing material to the inside of the printer cover or to cover the entire printer with a sound shield, as required. With such means, however, the noise generated by the printing mechanism cannot be sufficiently abated.

SUMMARY OF THE INVENTION

An object of this invention is to provide an impact receiving structure for an impact type printing mechanism which is designed so that unnecessary energy of printing hammers can be effectively absorbed in the platen structure nearest to the source of noise.

The principal structure of this invention is characterized in that vibration members for guiding along branched paths the vibration of an impact receiving face member, which is vibrated by the striking energy of a printing hammer, are provided at other positions than the printing face of the platen or at the inside of a type drum, and in that soft vibration absorbing materials are packed in close contact with the vibration members. With such a structure, it is possible to realize a printing mechanism having a platen or type drum which makes less noise attendant with the printing hammer impact.

With the impact receiving structure of this invention, since vibrations are remarkedly absorbed and attenuated in the frequency band exceeding several hundred Hz, discomfortable noises can be extremely abated. In addition, the vibration of the impact receiving member can be sufficiently reduced, so that very good printed pattern trains can also be obtained.

BRIEF DESCRIPTION OF THE DRAWING

FIGS. 5 and 6 are respectively a perspective view and a cross-sectional view showing another embodiment of this invention applied to a type drum;

FIGS. 7A and 7B are respectively a cross-sectional view and a front view and FIG. 8 is a perspective view illustrating another embodiment of this invention applied to a type drum of a compound structure.

DESCRIPTION OF PREFERRED EMBODIMENTS

FIGS. 1A, 1B and 2A, 2B illustrate embodiments of this invention in each of which the platen is formed as a unitary structure; and FIGS. 3A, 3B, 3C and 4A, 4B illustrate other embodiments in each of which the platen has a compound structure.

Figure 1A:
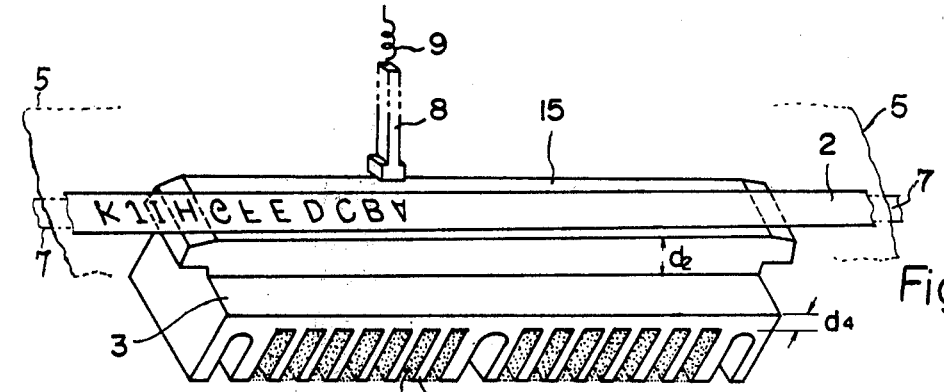
FIGS. 1A and 1B are respectively a perspective view and a back view illustrating an embodiment of this invention applied to a platen.
Figure 1B:
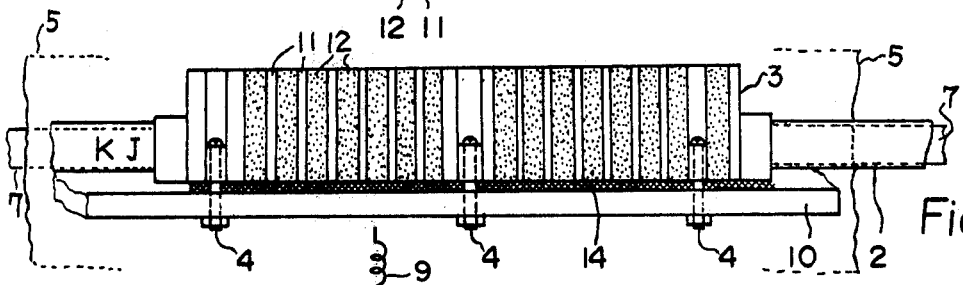

FIG. 1A is a perspective view showing the structure of the platen 3 viewed from the side of its impact face, and FIG. 1B is a back view. Vibration fins 11 and a vibration absorbing material 12 form the essence of this invention. In FIG. 1B, there is shown the rear side of the platen 3 secured by attachment means shown as bolts 4 to a base 10. As clearly shown, the vibration fins 11 are arranged at required intervals perpendicularly to an impact receiving face member 15 to provide branched paths of vibration, and the vibration absorbing material 12 (i.e. first buffer members) is packed in each of the spaces separating adjacent vibration fins 11, while the platen 3 is attached to the base 10 through a vibration absorbing member 14 (i.e. second shock absorbing member). The striking energy of each hammer 8 is received by the impact receiving face member 15 of the platen 3 through an ink ribbon 7, a recording paper 5 and a type belt 2. The hammer 8 is restored to the rest position by a spring 9. The resulting vibration propagates to the entire path of the platen 3 and, in this case, the vibration fins 11 are slightly vibrated by the impact, while the slight vibration is immediately absorbed by the elastic vibration absorbing material 12, such as rubber, provided in close contact with each of the vibration fins 11. The remainder of the vibration is similarly absorbed by the absorbing member 14 and only the remaining vibration attenuated thereby is transmitted to the base 10.

Figure 2A:
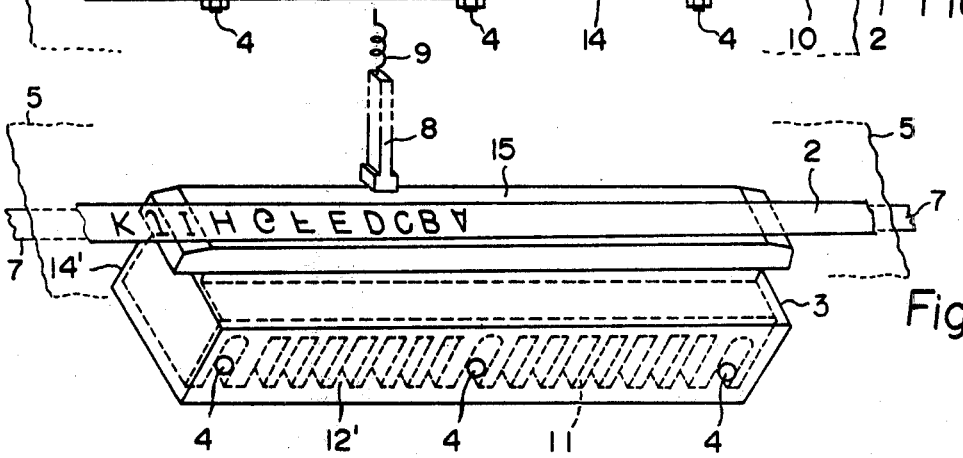
FIGS. 2A and 2B are respectively a perspective view and a back view showing a modified form of the embodiment depicted in FIGS. 1A and 1B.
Figure 2B:
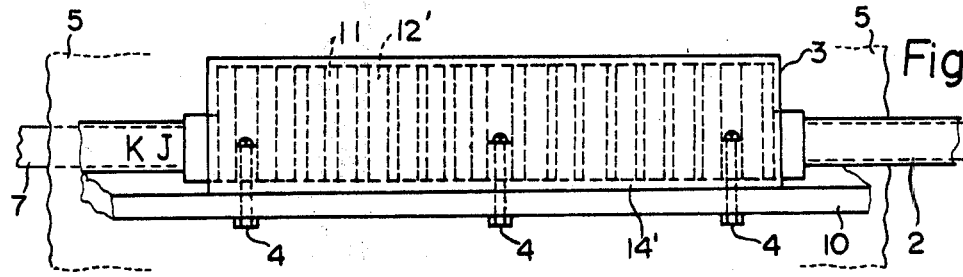

FIGS. 2A and 2B show an embodiment in which silicon rubber is used as the elastic absorbing material and the entire structure is formed by molding except holes for the attachment means 4 and the impact receiving face member 15. In the present embodiment, such metal material parts as the vibration fins 11, the impact receiving face member 15 and so on are formed as a unitary structure with one another, so that the impact receiving face member 15 is subjected to plane surface finishing and then the structure is molded with vibration absorbing material, as indicated by 12' and 14'.

FIGS. 3A, 3B, 3C and 4A, 4B illustrate other embodiments of this invention in each of which the platen structure is formed as a compound structure. In FIGS. 1A, 1B and 2A, 2B, the platen 3 has a fixed length of one full line but, in a case where one full line has a length of, for example, 80 or 132 digits, platens 3 for the exclusive use for such lengths are required. Further, when the hammer 8 strikes the impact receiving face 15 of the platen 3, if the long platen 3 is vibrated in the direction of the stroke of the hammer 8, even though a little, the operation timings of the hammers 8 actuated one after another may slightly vary and this error is a main cause of misalignment of printed characters. To avoid this, it is necessary to increase thickness $d_2$ and $d_4$ in the platen 3 as indicated in FIG. 1A for reducing the width of vibration in the direction of the stroke of the hammer 8 and to increase the number of attachment means 4 for more firmly fixing the platen 3 to the base 10. With the increased thicknesses $d_2$ and $d_4$, the impulsive shock by the hammer 8 is transmitted laterally in the impact receiving face member 15 and the energy absorbed by the vibration fins 11 is decreased, resulting in increased energy emitted as noise from the impact receiving face member 15.

The compound structure shown in FIGS. 3A, 3B, 3C and 4A, 4B provides a platen structure in which the lateral energy in the impact receiving face member 15 is mostly transmitted to the vibration fins 11 to absorb therewith the vibration energy to heighten the sound absorbing effect and whose length can be set at will by adding a desired number of blocks 30, 31. In the present embodiment, each block 30 has a length of one inch and, in a case of 80 digits, eight blocks 30 are assembled together and end blocks 31 are added to both ends of the assembly. In a case of 132 digits, thirteen blocks 30 are used and end blocks 31 are added to both ends of the block assembly.

Figure 3A:
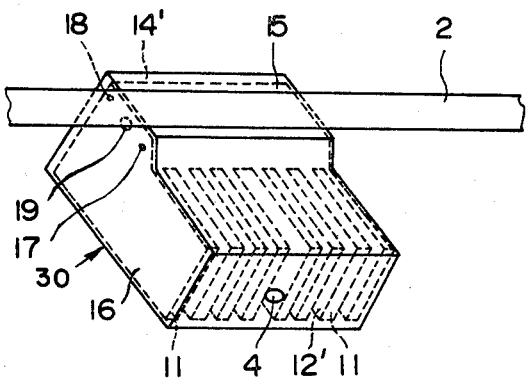
FIGS. 3A, and 3C are perspective views
Figure 3C:
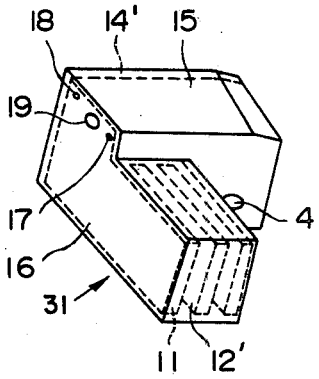
Figure 3B:
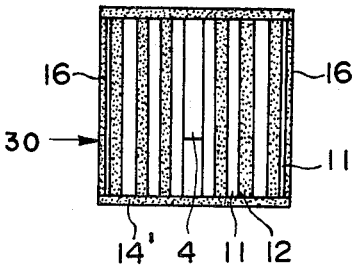
FIG. 3B is a back view showing another embodiment of this invention applied to a compound-structured platen.

FIG. 3A shows a block unit 30 of one inch length, FIG. 3B is its back view, and FIG. 3C shows the end block 31. The parts corresponding to those in FIGS. 1A and 1B are identified by the same reference numerals. In FIGS. 3A, 3B and 3C, reference numeral 16 indicates vibration absorbing materials (i.e. a third buffer member) attached to both sides of the block 30 and one side of block 31. When being given a shock from the impact receiving face member 15, the vibration absorbing materials 16 of each block 30 or 31 absorb the striking energy to adjacent blocks 30, 31 and cause the vibration fins 11 to absorb the striking energy. Each block 30 or 31 is covered by the molded elastic vibration absorbing materials 16 except the vibration fins 11 and the screw holes of the attachment means 4. Reference numerals 17 and 18 designate concavo-convex engaging members for assembling a plurality of blocks 30, 31, and 19 identifies a hollow hole.

Figure 4A:
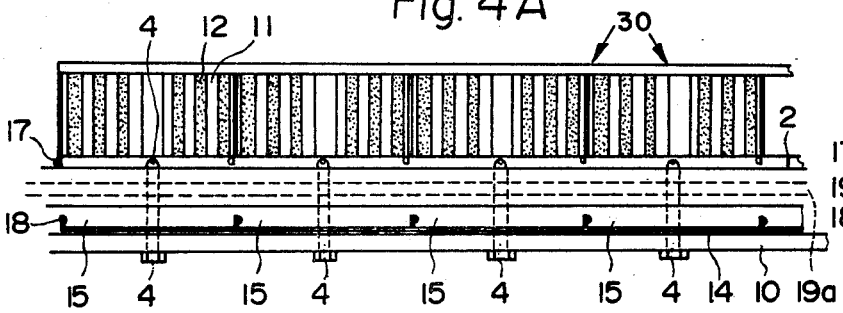
FIGS. 4A and 4B are respectively a back view and a side view illustrating the assembling of the embodiment of FIGS. 3A, 3B and 3C.
Figure 4B:
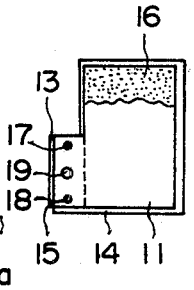

FIG. 4A is a back view of an assembly of the blocks 30. The blocks 30 are each joined with adjacent ones of them and held by the engaging members 17 and 18 in a correct positional relation to one another, and clamped together by a fixing rod 19*a* inserted into the hole 19. Further, each block 30 is fixed to the base 10 by screws 4. Reference numeral 13 denotes a thin plate of a hard material adhered to the impact receiving face member 15 of the platen 3 for preventing fluctuations in print quality which may occur when the hammer 8 strikes the vibration absorbing materials 16 attached to the sides of each block 30. The thickness of the vibration absorbing material 16 is sufficient to be about 0.3 mm. The thin plate 13 is provided for preventing fluctuations in print quality which may be caused by striking the hammer 8 on the elastic part of a thickness of about 0.6 mm which is formed by two vibration absorbing members 16 of adjacent blocks combined with each other.

FIGS. 5 and 6 illustrate another embodiment of this invention in which its impact receiving structure is applied to a drum-shaped type assembly for a high-speed line printer.

In FIGS. 5 and 6, vibration fins 41 are provided at the inside of each of closely arranged parallel, type discs 22 and the elastic vibration absorbing materials 42 are packed in close contact with the vibration fins 41. Further, the impact receiving face (on which the types are arranged, in this case) of each of the type discs 22 has a small thickness 23. Since the vibratory fins 41 increase the mechanical strength against the impact of the hammer 8 in the direction of its stroke, the thickness 23 can be reduced to be smaller than that usual in prior art, and the impact is easily transmitted to the vibration absorbing materials 42. FIG. 5 shows the external configuration of a cylindrical drum 20 formed by a number of closely arranged parallel, type discs 22. This configuration is indicated as a type drum, while the vibration fins 41, the vibration absorbing materials 42, 42', the types 21, the hammer 8, the hammer drive magnet structure, etc. are identical with those depicted in FIG. 6. When a drive current is applied to a magnet 28 from terminals 29, one end of an actuator 26 is attracted about a support shaft 27 to the magnet 28, so that the other end 25 hits the hammer 8 to print a corresponding type on a paper 5 through an ink ribbon 7.

FIGS. 7A, 7B and 8 illustrate another embodiment of this invention in which the type drum 20 is formed to have a compound structure as is the case with FIGS. 3A, 3B, 3C and 4A, 4B.

In FIG. 5, the type drum 20 is formed as one body but, in the present embodiment, the drum 20 is divided in its lengthwise direction into a plurality of blocks, each having for example, four type discs 22, and a desired number of type discs 22 are combined to obtain a type drum 20 having a required number of type digits 21. FIG. 8 shows a case in which, for instance, three blocks are assembled together. For example, in a case of 80 digits, twenty blocks are combined. It is also possible to form each block to have eight or sixteen type discs 22. In short, the vibration absorbing materials 46 are provided at the sides of individual blocks to prevent the hammer impact energy from propagation in the axial direction of the type drum 20.

In FIG. 7A, the vibratory fins 41, the elastic vibration absorbing materials 42, the drum thickness 23, the length 24 of each vibration fin 41, etc. are identical with those employed in FIG. 6. Projections 47, depressions 48, fixing and receiving holes 49 and rods 49*a* for assembling the blocks and for maintaining accuracy of the relative position of each of the blocks to adjacent ones of them are the same as those used in FIGS. 3A, 3B and 3C. Although FIG. 6 does not show the constructions of both end parts of the block assembly, end blocks produced on the basis of the same idea as in FIGS. 3A, 3B and 3C are provided at both ends of the block assembly. At the both ends of the assembly, the blocks are held together by the rods 49*a* to provide a required type drum 20.

With the structure shown in FIGS. 7A, 7B and 8, the striking energy of the hammer 8 is absorbed by the vibration fins 41 and the vibration absorbing materials 42, while the striking energy in each block is also absorbed by the vibration absorbing materials 46, so that the energy is not transmitted to other blocks and not emitted as noise.

As described in detail above, this invention produces the effect of remarkedly reducing noises of impact type printing mechanism and also provides the effect of improving printed character alignment by decreased vibration of the impact receiving face, and hence is very useful from the industrial point of view.

What we claim is:

1. An impact receiving structure for receiving impact by printing hammers in a printing mechanism, comprising:

impact receiving face means for receiving impact by said printing hammers;

vibration members coupled as a unitary structure to said impact receiving face means for guiding by branched paths vibration caused in said impact receiving face means by said impact; and vibration absorbing members disposed in close contact with said vibration members for absorbing said vibration.

2. An impact receiving structure according to claim 1, in which said absorbing members include buffer members packed in spaces separating adjacent ones of said vibration members.

3. An impact receiving structure according to claim 2, in which said vibration absorbing members are composed of first buffer members packed in spaces separating adjacent ones of said vibration members, and a second buffer member coupled to the open ends of said branched paths to cut off said branched paths.

4. An impact receiving structure according to claim 2, in which said vibration absorbing members are composed of first buffer members packed in spaces separating adjacent ones of said vibration members, a second buffer member coupled to the open ends of said branched paths to cut off said branched paths, and third buffer members disposed to divide the impact receiving face means in the lengthwise direction into a plurality of blocks.

5. An impact receiving structure according to claim 1, in which said vibration absorbing members are formed unitary with said vibration members by molding.

6. An impact receiving structure according to claim 1, in which said vibration members comprise spaced parallel fins integral with said impact receiving face means and said vibration absorbing members comprise vibration absorbing material in spaces between said fins.

* * * * *